United States Patent [19]

Smith

[11] Patent Number: 4,812,605

[45] Date of Patent: Mar. 14, 1989

[54] ELECTRIC SWITCH HOUSING WITH DUST TIGHT CHAMBER CAPTIVATING WIRE TERMINATION SCREWS

[75] Inventor: Jackson H. Smith, Union Grove, Ala.

[73] Assignee: Eaton Corporation, Cleveland, Ohio

[21] Appl. No.: 144,903

[22] Filed: Jan. 19, 1988

[51] Int. Cl.[4] ..... H01H 1/64

[52] U.S. Cl. ..... 200/284; 200/293; 200/303; 439/813

[58] Field of Search ..... 200/284, 302.3, 303, 200/339, 293, 302.1; 439/813

[56] References Cited

U.S. PATENT DOCUMENTS

| | | | |
|---|---|---|---|
| 3,314,043 | 4/1967 | Carissimi | 439/813 |
| 3,316,378 | 4/1967 | Ryan | 200/302.3 |
| 3,434,103 | 3/1969 | Hancock et al. | 439/813 |
| 4,081,641 | 3/1978 | Piber | 200/303 |
| 4,419,554 | 6/1983 | Osika | 200/284 |
| 4,669,806 | 6/1987 | Fuchs | 439/813 |

*Primary Examiner*—Renee S. Luebke

*Attorney, Agent, or Firm*—L. G. Vande Zande

[57] ABSTRACT

A switch housing extends to enclose wiring terminals, incorporating holes for insertion of wire conductors and for accessing a clamping screw assembly with a tool to clamp the conductor against the terminal. Individual cavities for each terminal are substantially sealed against ingress of dust, electrically isolating the terminals, and preventing removal of the screw from the respective cavity.

13 Claims, 2 Drawing Sheets

ELECTRIC SWITCH HOUSING WITH DUST TIGHT CHAMBER CAPTIVATING WIRE TERMINATION SCREWS

BACKGROUND OF THE INVENTION

This invention relates to wiring terminals for electrical apparatus. More particularly, the invention relates to electric switches wherein the housing is extended to substantially enclose the wiring terminals.

Electric switches used to control apparatus which operates in a high dust environment require particular sealing structures to prevent the contacts from becoming contaminated or fouled by the dust. A general reduction in size of hand held tools such as electric sanders has reduced the size available for the electric switch for controlling the sander, thereby requiring a similar reduction in size of the switch. As a result of such size reduction, the space provided between wiring terminals is commonly at a minimum distance acceptable to the various certifying agencies. When used in a hand sander or similar device, dust penetrating the housing of the sander can build up in the wire termination area of the switch, establishing an electrical bridge across the terminals and creating a potential hazard for the apparatus. Another problem encountered with electrical switch wiring terminals when the switch is used on apparatus subject to vibratory motion is that the screws tend to loosen and occasionally fall out of the terminal hole before the electrical connection is actually broken, and the screw is then very susceptible to being permanently lost.

This invention provides a switch which is well suited for miniaturization wherein the housing is provided with a separate chamber for the wiring terminals, such chamber being sealed off from the switch contact chamber and essentially sealed off from the exterior of the housing. Each terminal assembly is provided with an individual substantially sealed cavity within the housing to isolate it from adjacent terminal assemblies. The housing is provided with openings for inserting wire conductors to the terminal assemblies and access openings for the screws of the terminal assemblies, and further serves to form a simple structure for captivating or retaining the screw within the housing, and where so desired, assembled to the terminal.

SUMMARY OF THE INVENTION

This invention provides an electrical apparatus having screw type wiring terminals wherein the housing for the apparatus surrounds the terminals to provide a separate dust tight cavity individual to each wiring terminal. The housing is provided with openings at each cavity to provide access to the wiring terminal screw by an appropriate tool and is provided with openings for inserting a wire into position in the terminal assembly. The housing functions to retain the screw in the cavity and/or maintain it assembled to the terminal by limiting movement of the screw to an amount less than that required to disengage the screw from a threaded opening in the terminal. The invention, its features and advantages will become apparent in the following description and claims when read in conjunction with the accompanying drawings.

DETAILED DESCRIPTION OF THE PREFERRED EMBODIMENTS

Figure 1:
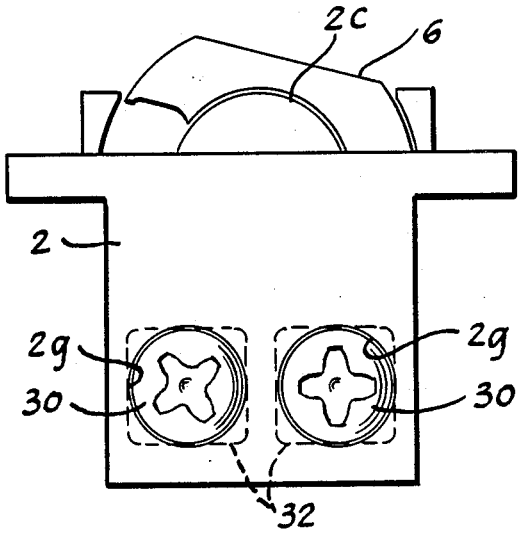
FIG. 1 is a side elevational view of an electric switch having a housing which extends to enclose the wiring terminal structure in accordance with this invention.

The switch constructed in accordance with this invention and as shown in the drawings is particularly well suited to miniaturization. It is also well suited to automated assembly which provides distinct economic advantages. Although it is shown as a rocker operated switch, it is also contemplated that the rocker may be formed with an upstanding lever to alternatively provide a toggle lever operator for the switch. The switch housing comprises a pair of molded insulating base halves which are separated along an upright parting plane extending from the top, or operator end to the bottom, or wire termination end, of the switch perpendicularly to the axis of rotation of the operator.

Figure 2:
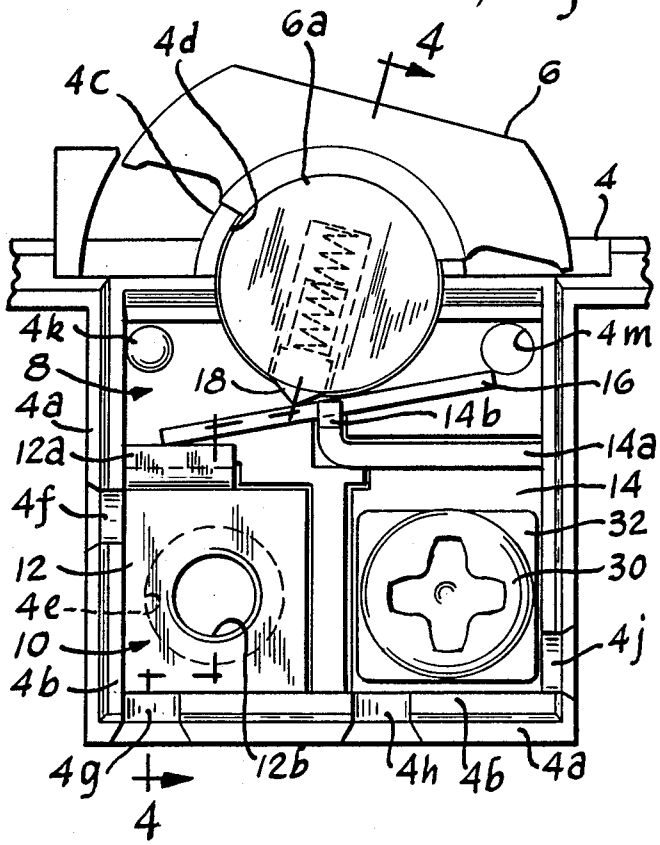
FIG. 2 is a elevational view of the switch of FIG. 1, drawn to an enlarged scale, and having a front housing half removed therefrom.

Referring specifically to the drawings, the switch housing comprises a front base half 2 as oriented in FIGS. 1 and 2 of the drawings, and a rear base half 4. Base halves 2 and 4 are complementally structured at their adjoining faces to provide a modified tongue and groove juncture along the periphery of the housing halves. Rear housing half 4 has a forwardmost projecting surface or flange 4*a* extending along its outer peripheral edge and a recessed peripheral surface 4*b* positioned immediately inside the peripheral flange 4*a*. Front housing half 2 is provided with a forwardmost extending surface or flange 2*a* located immediately inside a recessed outer peripheral flange 2*b*. As may be seen along the lower edge of FIG. 4, the surfaces 2*a*, 4*b* and 2*b*, 4*a* complementally engage each other, as do the inclined surfaces extending therebetween when the two base halves are assembled together.

Figure 4:
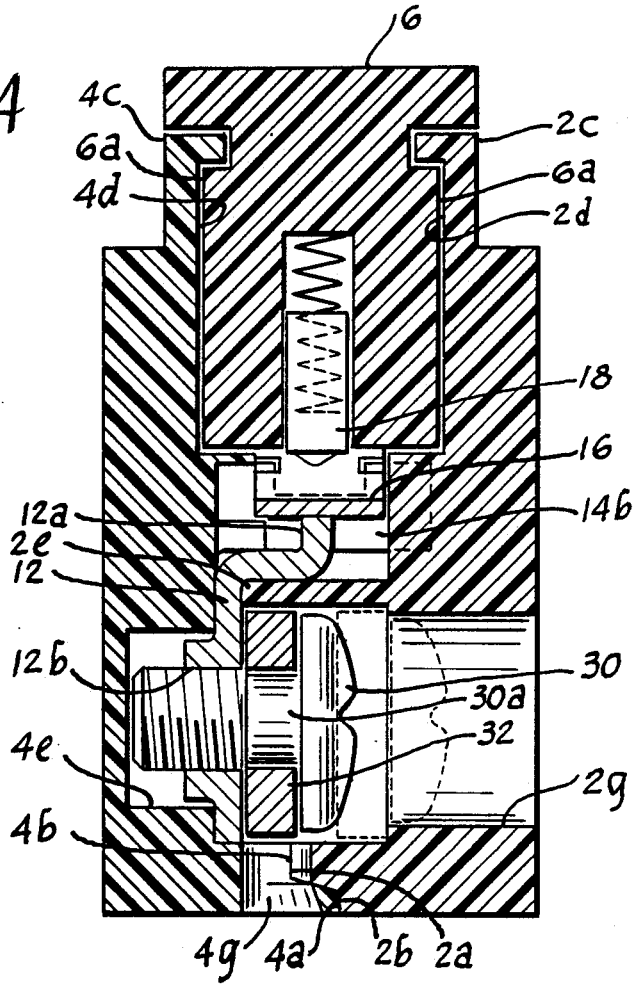
FIG. 4 is a cross sectional view taken along the line 4—4 in FIG. 2.
Figure 3:
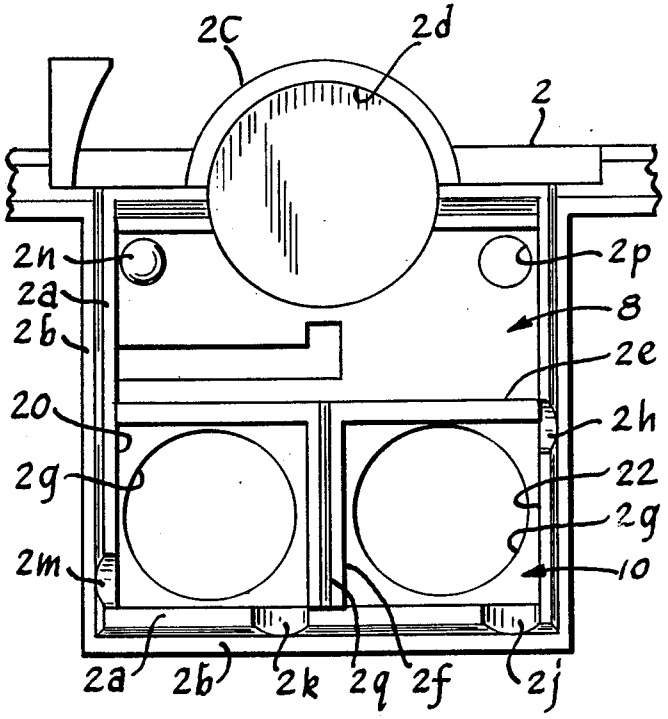
FIG. 3 is an elevational view of the front housing half which was removed in FIG. 2, viewed from the inner surface.

Each housing half 2 and 4 is provided with an arcuate upstanding projection 2*c* and 4*c*, respectively, at the upper surface thereof. As seen in FIGS. 2 and 3, cylindrical recesses 2*d* and 4*d*, respectively, are provided on the inner face of each of the housing halves concentrically with the arcuate projection 2*c* and 4*c*. A rocker button operator 6 is mounted for rotational movement within the housings by positioning a cylindrical lower body 6*a* thereof within the respective cylindrical recesses 2*d*, 4*d*. The upper portion of operator 6 is formed to overlie the arcuate projections 2*c*, 4*c* and the upper portion of the switch housing to provide an overlying structure which substantially closes off the operator opening in the switch housing, thereby to prevent the ingress of dust and other contaminants into the switch housing. As can be seen in FIG. 4, the arcuate projections 2*c*, 4*c* and the operator 6 form a sealing labyrinth at their junctures. The assembled base halves 2 and 4 establish a hollow chamber within the housing which is divided into an upper chamber 8 housing the switch contacts and a lower chamber 10 housing the wiring terminal members by a horizontal wall 2e of front base half 2.

Rear base half 4 is provided with recessed pockets in the interior surface of its side wall for receiving contact-/terminal members 12 and 14 therein. Each of the members 12 and 14 comprise essentially flat plates which rest within the recessed pockets flush with the interior surface of the side wall of the housing 4. Member 12 has a tab 12a formed forwardly and upwardly along a portion of its upper edge to function as a stationary contact for the switch. The upper edge of member 14 is also formed over forwardly to provide a horizontally disposed tab 14a. The left-hand end of tab 14a is formed upwardly transversely of the switch to extend within pockets formed in the interior surfaces of side walls of housing halves 2 and 4. Upwardly extending transverse tab 14b is provided with a centrally disposed recessed portion to provide a fulcrum for a rocking movable contactor 16 in a well known manner. The contactor 16 is provided with lateral notches which cooperate with the outer edges of upright tab 14b to position the contactor 16 on the fulcrum. The cylindrical body 6a of operator 6 has a cavity containing a spring biased plunger 18 which is biased into engagement with the upper surface of contactor 16. In a well known manner, contactor 16 is rocked into and out of engagement with stationary contact 12a as plunger 18 is moved back and forth across the pivot provided by of tab 14b by rotary motion of the operator 6. Wall 2e of the front housing half 2 extends to engage the flat surfaces of terminal/contact members 12 and 14 and the interior surface of the side wall of housing half 4 to close off the upper chamber 8 from the lower chamber 10.

Referring to FIG. 3, an upright wall 2f is provided in the lower chamber 10 of housing half 2, the wall 2f extending from the surface 2a to the horizontal wall 2e. Walls 2a, 2e and 2f cooperate to form individual rectangular cavities 20 and 22, respectively, for each contact-/terminal member 12 and 14 within the lower chamber 10 of the switch housing. A pair of circular openings 2g are provided in the side wall of front housing half 2 in communication with the respective cavities 20 and 22. Housing half 4 is provided with cylindrical recesses 4e in the interior surface of the side wall thereof in an area immediately behind the contact/terminal members 12 and 14 and in axial alignment with a threaded hole in the respective contact/terminal member such as shown at 12b in FIG. 2. Rear housing half 4 is provided with semicircular slots 4f, 4g, 4h and 4j in the peripheral walls. Front housing half 2 is provided with similar arcuate slots 2g, 2j, 2k and 2m which align respectively with the aforementioned slots in rear housing half 4 when the two housing halves are assembled to provide openings communicating with the respective cavities 20 and 22 through which a wire conductor (not shown) may be inserted for connection of the switch to an electric circuit.

In addition to the modified tongue and groove structure of the peripheral surfaces 2a, 2b and 4a, 4b, the base halves 2 and 4 are provided with complementally located projecting pins 2n, 4k, respectively and pin receiving recesses 2p, 4m, respectively which engage with a press fit upon assembly of the base halves to correctly align the base halves and to maintain the two base halves assembled together. Upright wall 2f is also provided with a forwardly projecting V-shaped rib 2q which abuts a corresponding surface portion of the wall of rear housing 4 for purposes of ultrasonically welding the two housing halves together.

Prior to final assembly and ultrasonic welding of the two housing halves, each contact/terminal 12 and 14 is provided with a screw assembly 30 which is threadably engaged in the hole (such as 12b) of each of the contact-/terminal members 12, 14. In a preferred embodiment, the screw 30 has a rectangularly formed clamping member 32 rotatably captivated thereon in a reduced diameter portion 30a immediately adjacent the head of screw 30 by the enlarged outer diameter of the threaded shank of the screw. The screw is axially aligned with the openings 2g in front housing half 2 to permit a tool such as a screwdriver Allen head wrench or the like, to be inserted and engaged within a corresponding tool receiving recess formed in the head of screw 30. By suitably rotating the screw 30, the clamping member 32 may be linearly advanced or retracted in the axial direction of screw 30 toward or away from the surface of the respective terminal portion of contact/terminal 12 or 14. When advanced toward the terminal 12 or 14, the clamping member 32 engages and clamps a wire conductor inserted through one of the openings in the peripheral wall of the housing into electric circuit making engagement with the face of the terminal. When the screw 30 is retracted from the face of the terminal, its movement in the outward direction is limited by engagement of the corners of the rectangular clamping member 32 with the inner surface of housing half 2 adjacent the periphery of the circular openings 2g, thereby preventing the screw 30 from being removed intentionally or accidentally falling out of the assembled switch. Although the rectangular clamping member preferably provides four corner areas for good interfering engagement with the inner surface of housing half 2, it is also contemplated that an enlarged circular washer could be captivated on screw 30 to provide the necessary clamping and retaining functions. It is further contemplated that an enlarged washer could be formed integral with the head of the screw 30 or that the head of the screw itself would perform the clamping function, in which case the opening 2g would be made smaller than the diameter of the head of screw 30, all of which alternatives would function to maintain the screw 30 within the respective cavity 20 or 22. Although the size of the wire conductor and the available space within the cavity 20, 22 as determined by the external dimensions of the housing are primary factors in determining the amount of travel of screw 30, it should be appreciated that the cavity could be proportioned to stop screw 30 before the threaded shank thereof disengages the terminal hole.

While a preferred embodiment has been described hereinabove and certain specific alternatives have been contemplated, it is to be understood that the invention is subject to further modification without departing from the scope of the appended claims.

I claim:

1. Electrical apparatus comprising:

an insulating housing having an interior cavity;

a wiring terminal enclosed by said cavity having a threaded opening therein;

a screw disposed within said cavity threadably received in said threaded opening, said screw having a tool receiving recess in one end and axially fixed transversely disposed clamping means adjacent said one end;

a first opening in said housing communicating with said cavity through which a wire conductor is inserted between said terminal and said clamping means;

a second opening in said housing communicating with said cavity axially aligned with said screw and through which a tool is engagable within said recess; and abutment means in said cavity comprising an interior surface of a wall of said housing defining said cavity and containing said second opening engaged by said clamping means preventing removal of said screw through said second opening.

2. The electrical apparatus as claimed in claim 1 wherein said screw remains threadably engaged with said terminal when said clamping means engages said abutment means.

3. The electrical apparatus as claimed in claim 1 wherein said clamping means comprises a washer integral with said screw.

4. The electrical apparatus as claimed in claim 1 wherein said clamping means comprises a washer rotatably captivated on said screw.

5. The electrical apparatus as claimed in claim 1 wherein said clamping means comprises a rectangular plate rotatably captivated on said screw and said second opening is circular, corners of said plate abutting said interior surface adjacent peripheral edges of said second opening.

6. An electric switch comprising:

an insulating housing having an interior chamber;

switch contacts in one portion of said chamber;

means for actuating said switch contacts disposed in said one portion of said chamber and operable exteriorly of said housing;

terminals connected with said switch contacts disposed in a second portion of said chamber;

wall means in said housing closing off said one portion of said chamber from said second portion thereof and dividing said second portion into separate cavities each individually enclosing a respective one of said terminals, each said individual cavity and respective enclosed terminal comprising:

an opening in said terminal;

a screw disposed within said cavity threadably received in said opening in said terminal, said screw having a tool receiving recess in one end and axially fixed clamping means adjacent said one end;

a first opening in said housing communicating with said cavity through which a wire conductor is inserted between said terminal and said clamping means;

a second opening in said housing communicating with said cavity axially aligned with said screw through which a tool is engagable with said recess; and abutment means in said cavity comprising an interior surface of a wall of said housing defining said cavity and containing said second opening engaged by said clamping means preventing removal of said screw through said second opening.

7. The electrical switch as claimed in claim 6 wherein said screw remains threadably engaged with said terminal when said clamping means engages said abutment means.

8. The electrical apparatus as claimed in claim 6 wherein said clamping means comprises a washer integral with said screw.

9. The electrical apparatus as claimed in claim 6 wherein said clamping means comprises a washer rotatably captivated on said screw.

10. The electrical apparatus as claimed in claim 6 wherein said clamping means comprises a rectangular plate rotatably captivated on said screw and said second opening is circular, corners of said plate abutting said interior surface adjacent peripheral edges of said second opening.

11. An electric switch as claimed in claim 10 wherein:

said insulating housing comprises a pair of housing halves split along a plane spanning both said one portion and said second portion of said chamber;

said terminals are recessed in an interior wall of said second portion of said chamber of one of said housing halves flush with an interior surface thereof; and said wall means project from an interior surface of the other of said housing halves into engagement with said terminals and said interior surface of said one of said housing halves.

12. An electric switch as claimed in claim 11 wherein said housing halves comprise complemental overlapping edges along said split to form a sealed juncture when assembled together.

13. An electric switch as claimed in claim 12 wherein said switch contacts comprise integral portions of said terminals disposed along said wall means in said one portion of said chamber.

* * * * *